US008015711B2

(12) United States Patent
Psimadas et al.

(10) Patent No.: US 8,015,711 B2
(45) Date of Patent: Sep. 13, 2011

(54) RAZOR HAVING TWO SLIDEABLE SHAVING HEADS

(75) Inventors: Yiannis Marios Psimadas, Athens (GR); Ioannis Bozikis, Athens (GR); Dimitris Efthimiadis, Athens (GR)

(73) Assignee: BIC-Violex SA, Anixi, Attiki (GR)

( * ) Notice: Subject to any disclaimer, the term of this patent is extended or adjusted under 35 U.S.C. 154(b) by 817 days.

(21) Appl. No.: 10/598,827

(22) PCT Filed: Mar. 15, 2005

(86) PCT No.: PCT/EP2005/003458
§ 371 (c)(1), (2), (4) Date: Sep. 12, 2006

(87) PCT Pub. No.: WO2005/090017
PCT Pub. Date: Sep. 29, 2005

(65) Prior Publication Data

US 2007/0180699 A1 Aug. 9, 2007

(30) Foreign Application Priority Data

Mar. 15, 2004 (WO) ..... PCT/EP2004/003670

(51) Int. Cl.
*B26B 21/52* (2006.01)
*B26B 21/40* (2006.01)

(52) U.S. Cl. ..... 30/34.1; 30/526

(58) Field of Classification Search ..... 30/34.1, 30/47, 50, 51, 526
See application file for complete search history.

(56) References Cited

U.S. PATENT DOCUMENTS

| | | | | |
|---|---|---|---|---|
| 843,923 | A | 2/1907 | Arnold | |
| 2,242,900 | A | 5/1941 | Bender | |
| 4,461,078 | A | 7/1984 | Carreker | |
| 4,498,236 | A | 2/1985 | McIntyre et al. | |
| 5,157,835 | A | 10/1992 | Lazarchik et al. | |
| 5,608,972 | A | 3/1997 | Tsae-Chyn | |
| 6,052,905 | A | 4/2000 | Branchinelli et al. | |
| 6,125,857 | A * | 10/2000 | Silber | 132/215 |
| 6,560,876 | B2 * | 5/2003 | Carr | 30/50 |
| 6,928,738 | B2 | 8/2005 | Segrea | |

FOREIGN PATENT DOCUMENTS

| | | |
|---|---|---|
| CA | CA 2 184 639 | 4/1998 |
| FR | 2601 893 | 1/1988 |
| JP | 8-257263 | 10/1996 |
| JP | 8-323066 | 12/1996 |
| JP | 08 323067 | 12/1996 |
| JP | 8-323067 | 12/1996 |
| JP | 2000 279658 | 10/2000 |
| JP | 2000 287743 | 10/2000 |
| JP | 2002 279224 | 10/2000 |

* cited by examiner

*Primary Examiner* — Clarke F. Dexter
(74) *Attorney, Agent, or Firm* — Jones Day

(57) ABSTRACT

A razor that includes an elongated hollow handle having a front end and a back end. The razor also includes a first razor head and a second razor head, which are both mounted on a support the support being mounted in the handle and slideable along the length of the handle between a first use position and a second use position. The first use position allows the first razor head to project outward from the front end of the handle to allow shaving, while the second razor head is retracted within the handle; the second use position allows the second razor head to project outward from the back end of the handle to allow shaving, while the first razor head is retracted within the handle. The use positions are preferably attained by a manually operable actuator for moving the razor head from one position to the other.

6 Claims, 15 Drawing Sheets

RAZOR HAVING TWO SLIDEABLE SHAVING HEADS

This application is a national stage application of PCT/EP2005/003458, filed on Mar. 15, 2005.

FIELD OF THE INVENTION

The embodiments of the present invention relate to safety razors and, more specifically, to razors provided with two shaving heads.

BACKGROUND OF THE INVENTION

Several attempts have been made to propose a razor including at least two shaving heads having different sizes to allow shaving of different hair areas of the body.

U.S. Pat. No. 4,461,078 granted to Carreker discloses a razor assembly including first and second handle portions, with first and second razor heads mounted at the ends of the handle portions. The handle portions are pivotally mounted together so that the heads may be moved from a position wherein the handle portions are substantially in a straight line with the heads widely spaced, to a position wherein the handle portions make a small acute angle with the heads close to each other.

U.S. Pat. No. 4,285,124 granted to Diakonov discloses a safety razor comprising a normal sized razor head and a retractable miniature razor head which is movable from a first position where it is retracted behind the normal sized head to a second position where it is deployed above the normal sized head for use in trimming the area beneath the center of the user's nose.

One disadvantage of such razors is that the use thereof is not perfectly safe. The user has to be very cautious in order not to cut himself or herself with one razor head while using the other.

A further disadvantage of Carreker's razor is that its handle is near twice as long as a standard razor handle, which makes it difficult to comfortably grip the handle.

SUMMARY OF THE INVENTION

It is an object of the embodiments of the present invention to provide a razor having two shaving heads, the use of which is safer.

It is another object of the embodiments of the present invention to provide a razor, the use of which is more comfortable.

The razor according to an embodiment of the present invention comprises:

an elongated hollow handle having a longitudinal axis, the handle having a front end and a back end opposite to the front end, a first razor head and a second razor head, both mounted onto a support which is mounted in the handle and is slideable with respect of the same along a direction substantially parallel to the axis, between at least:

- a first use position in which the first razor head projects outward from the front end of the handle to allow shaving, while the second razor head is lodged within the handle, and
- a second use position in which the second razor head projects outward from the back end of the handle to allow shaving, while the first razor head is lodged within the handle, and a manually operable actuator mounted on the support for moving the same from one position to the other.

Accordingly, while the one head is an in use position, the other is substantially out of reach, thereby decreasing the risk that the user could cut himself or herself.

The razor according to embodiment of the present invention is also compact, which allows comfortable gripping while shaving.

According to a preferred embodiment of the present invention, the support is capable of occupying a third or intermediate position in which both razor heads are lodged within the handle.

The razor may also comprise means for locking the support in its first use, second use or intermediate position.

Such locking means may be at least partly provided onto the manually operable actuator.

The actuator preferably comprises a hollow body and a pusher provided with arms capable of being clipped in slots provided in the handle. The pusher is slideable with respect to the body, between a locking position in which the arms are received in the slots, and an unlocking position in which the arms are located outward from the slots.

The razor preferably comprises a compression spring which permanently biases the pusher toward its locking position.

Furthermore, the handle may comprise two longitudinal rails which slidingly cooperate with the support so as to guide the support during movement.

The razor heads preferably have different sizes, in order to allow shaving of different hair areas of the body.

In a preferred embodiment of the present invention, where each razor head resides in a removable cartridge, the razor includes a lock-and-release mechanism for disposal and replacement of each razor head.

Each lock-and-release mechanism is preferably mounted on the support, at an end thereof, and comprises:

a resilient V-shaped retainer having two legs provided with bearing members for the mounting of a razor head, the legs having lateral wings;

a plunger;

a spring biasing the plunger towards the razor head;

a cam member for biasing the legs of the retainer away from each other, the razor further comprising a pair of actuators for triggering said lock-and-release mechanism, each actuator comprising:

a flat spring member having a fixed portion attached to the handle and a flexible portion, a button accessible to the fingers of a user and cooperating with the flexible portion, wherein, in one use position, the lateral wings cooperate with the flexible portion (thereby allowing disposal and replacement of the razor head), whereas in the intermediate position or in the other use position the lateral wings cooperate with the fixed portion (thereby preventing disposal of the razor head).

In a preferred embodiment of the present invention, wherein the handle comprises a top shell member and a bottom shell member, in addition to their triggering function, the spring members form clip members for holding the shell members together.

More precisely, the fixed portion of each spring member comprises a pair of holes which cooperate with hooks formed in the top shell member and the bottom shell member, respectively.

In addition, the razor may comprise a movable or flexible cover covering each end of the handle when the corresponding razor head is lodged within the handle.

The above and other objects and advantages of the embodiments of the present invention will become apparent from the detailed description of the preferred embodiments of the present invention, considered in conjunction with the accompanying drawings.

Figure 1:
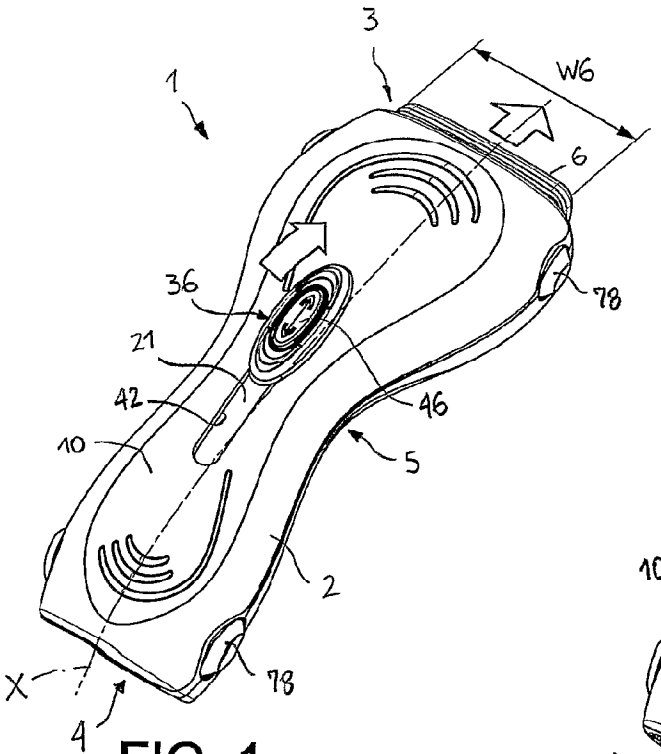
FIG. 1 is a perspective view of a razor according to a preferred embodiment of the present invention, shown in a first use position.
Figure 2:
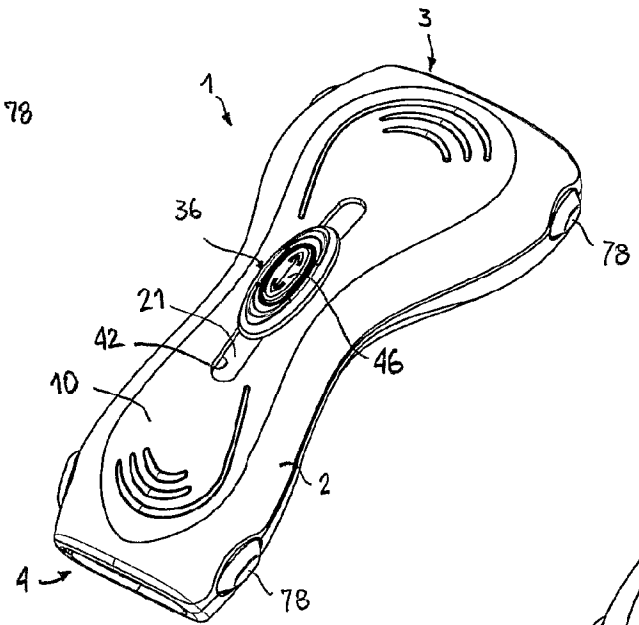
FIG. 2 is a perspective view of the razor of FIG. 1, shown in an intermediate position.

A razor according to the embodiments of the present invention is generally indicated by reference number 1 in the drawings.

Razor 1 comprises a handle 2 which is elongated along a longitudinal axis X. Handle 2 is preferably is hollow, thereby forming a housing defining an open front end 3 and an opposite open back end 4. It has a central constriction 5 and presents in side view an arcuate shape, thereby providing comfortable hand grasping. Therefore, the handle axis X can be considered as an arcuate average line joining the center points of the open ends 3, 4.

Razor 1 further comprises a first shaving blade unit or head 6, including one or more blades (three in the illustrated example) and which is mounted at the front end 3 of the handle 2 so that the edges of the blades are substantially perpendicular to the handle axis X.

Figure 11:
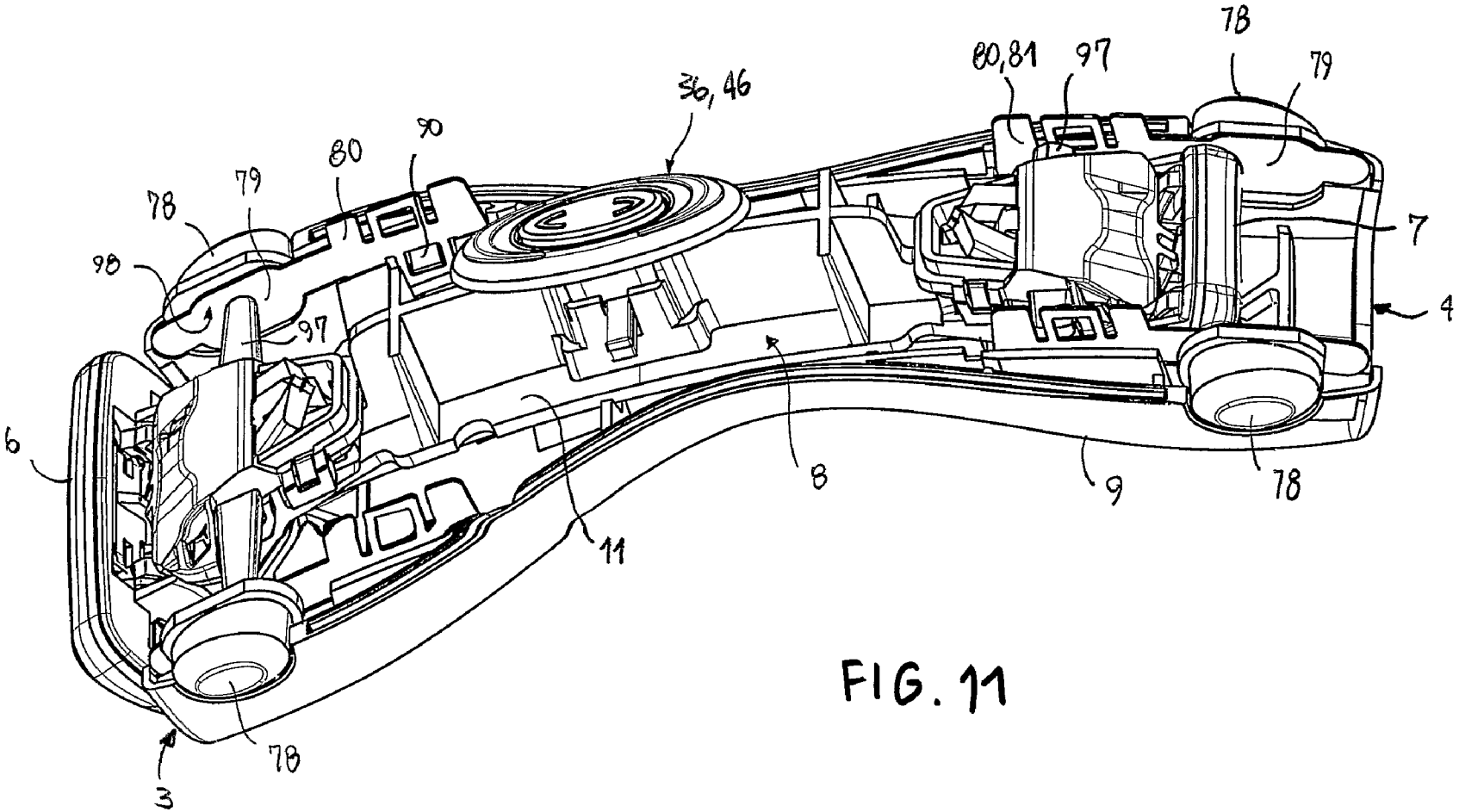
FIG. 11 is a view similar to FIG. 8, showing the razor in a first use position.
Figure 12:
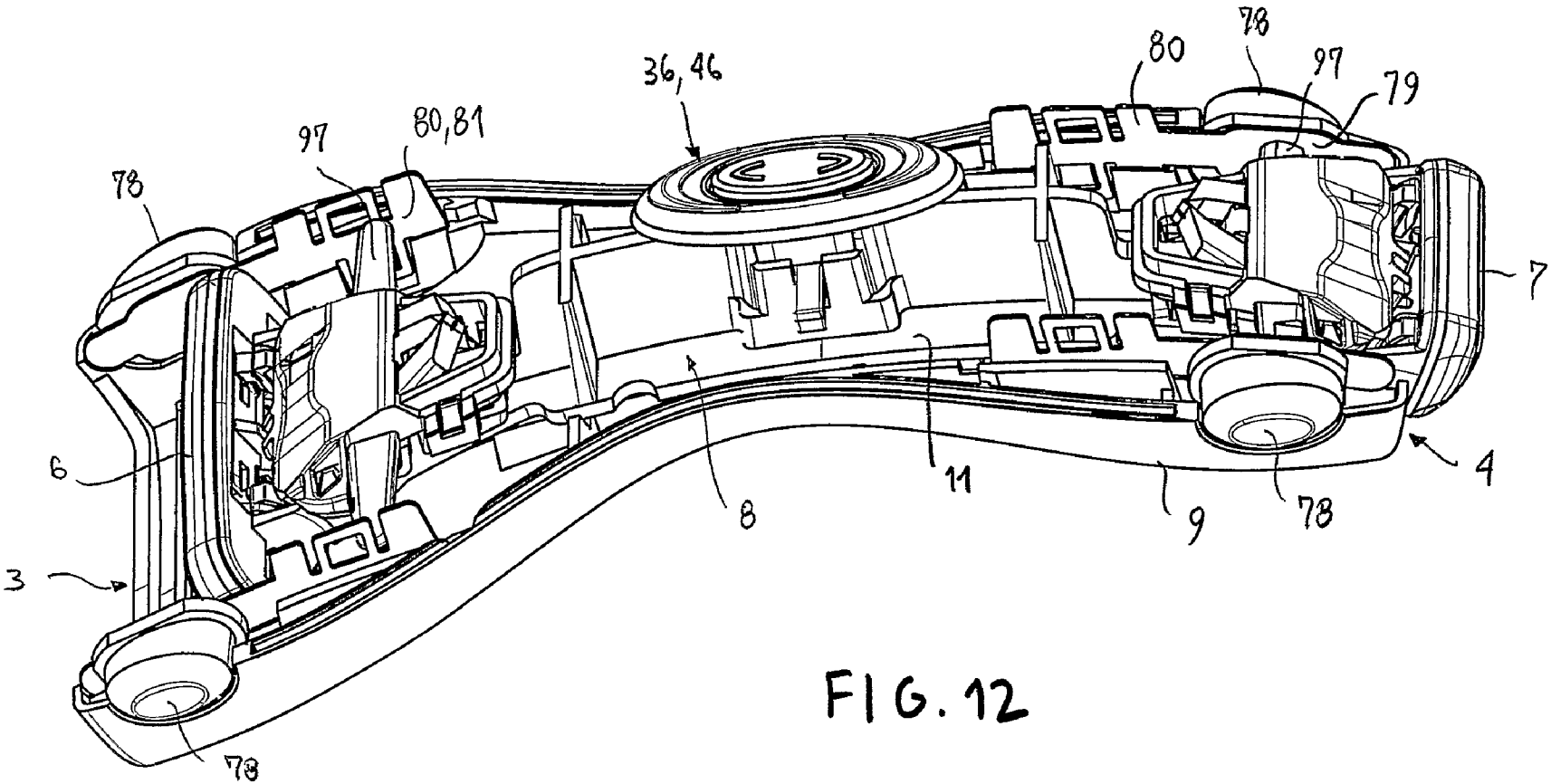
FIG. 12 is a view similar to FIG. 8, showing the razor in a second use position.
Figure 14:
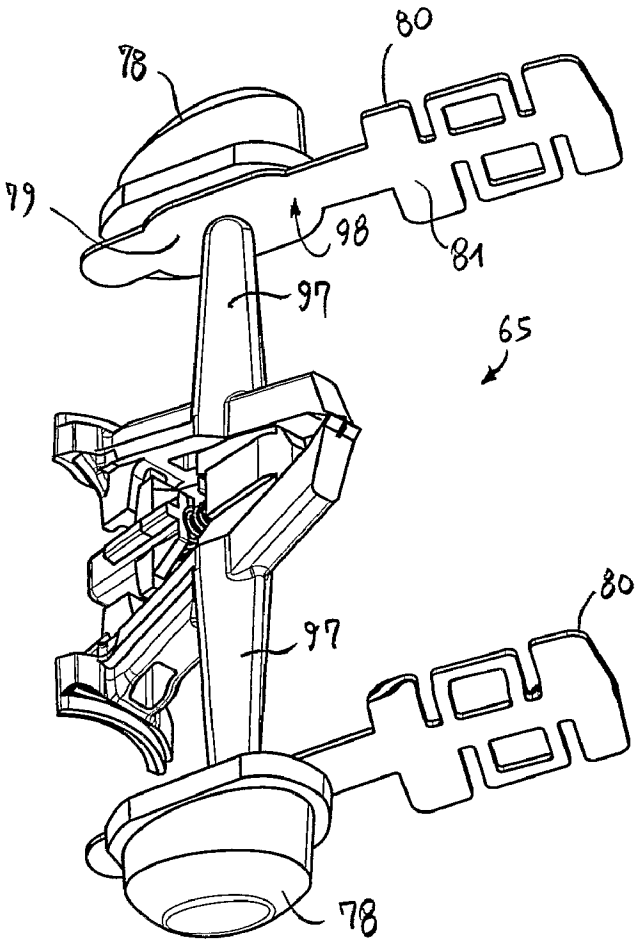
FIG. 14 is view similar to FIG. 13, showing the lock-and-release mechanism in a first use position.
Figure 13:
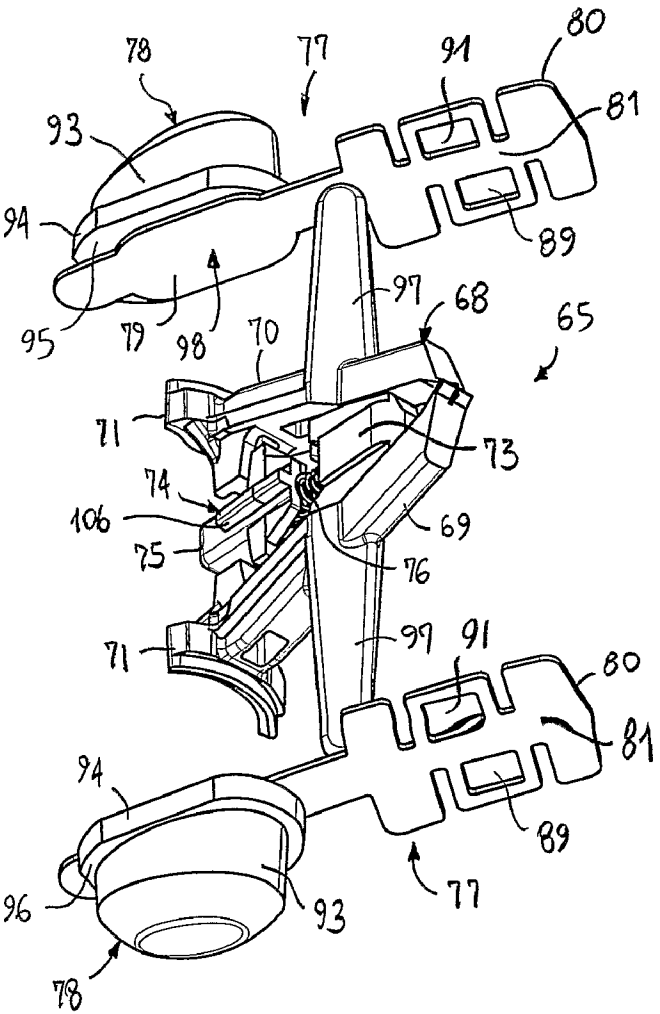
FIG. 13 is a top perspective view showing a lock-and-release mechanism for the razor of the preceding figures, in an intermediate position.

First head 6 is movable with respect of the handle 2 along a direction substantially parallel to the handle axis X, between:

a use position in which the head 6 projects outward from the front end 3 of the handle 2 (FIGS. 1, 11) and a retracted position in which the head 6 is lodged within the housing formed within the handle 2 (FIGS. 2, 3, 6, 8, 12).

In the use position, the first head 6 is ready for use to allow shaving, while in the retracted position it is hidden in the handle 2 so that it is inoperable and substantially unreachable with the fingers to be protected from damage and avoid any accidental cutting.

Figure 5:
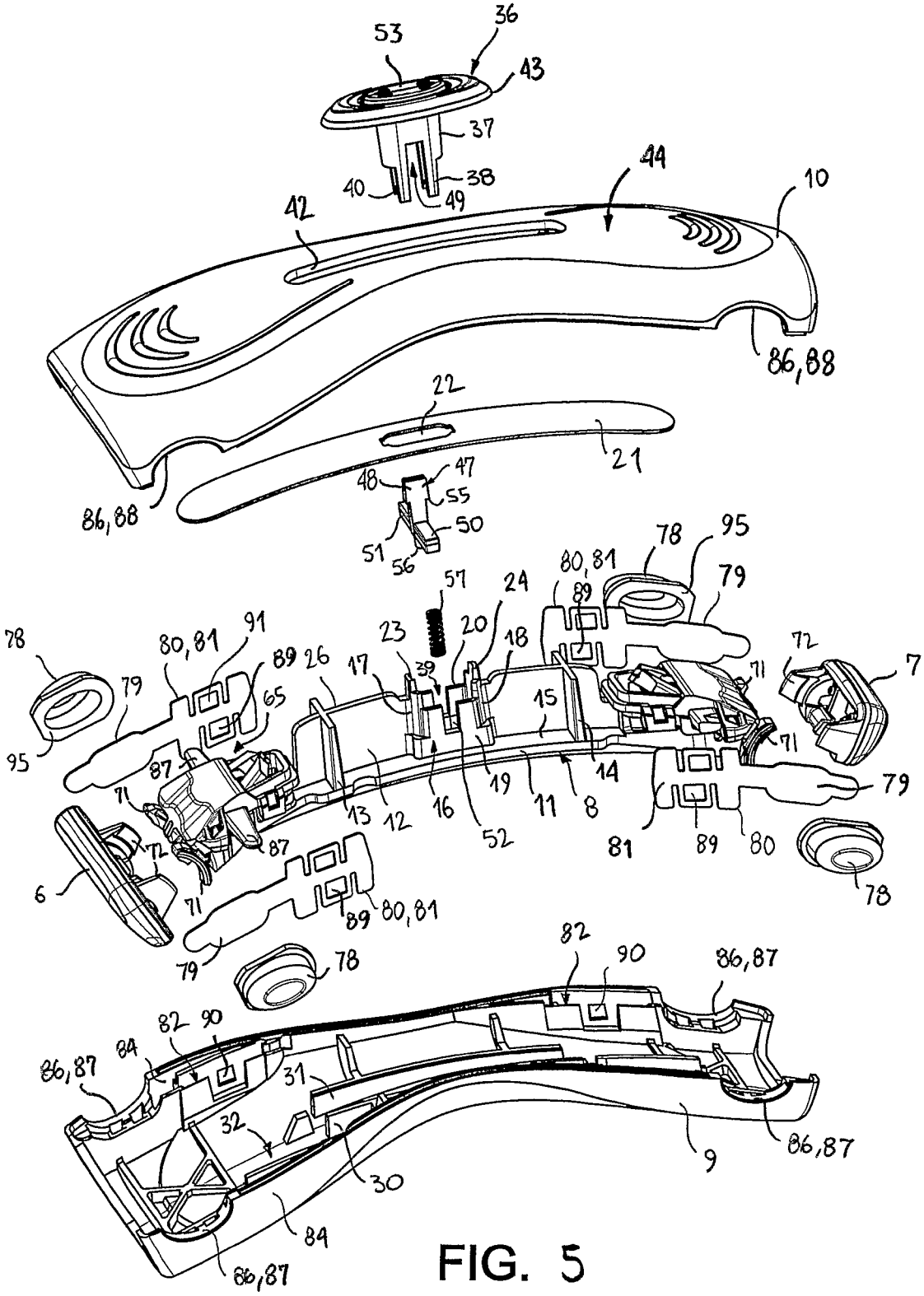
FIG. 5 is an exploded perspective top view of the razor of the preceding figures.

As illustrated in FIG. 5, razor 1 also comprises a second blade unit or head 7 comprising one or more blades (two in the illustrated example) and which is mounted at the back end 4 of the handle 2 so that the edges of the blades are substantially perpendicular to the handle axis X. In other words, first head 6 and second head 7 extend substantially parallel to each other.

Figure 3:
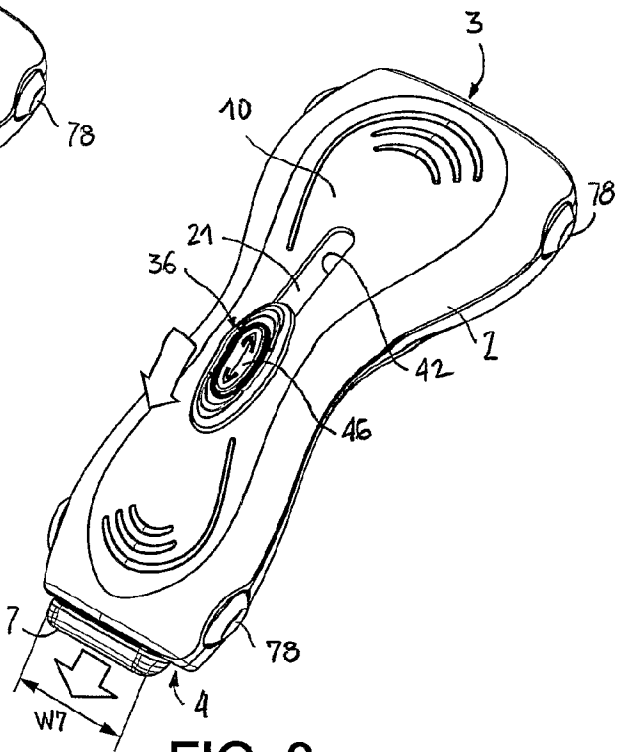
FIG. 3 is a perspective view of the razor of FIGS. 1 and 2, shown in a second use position.
Figure 4:
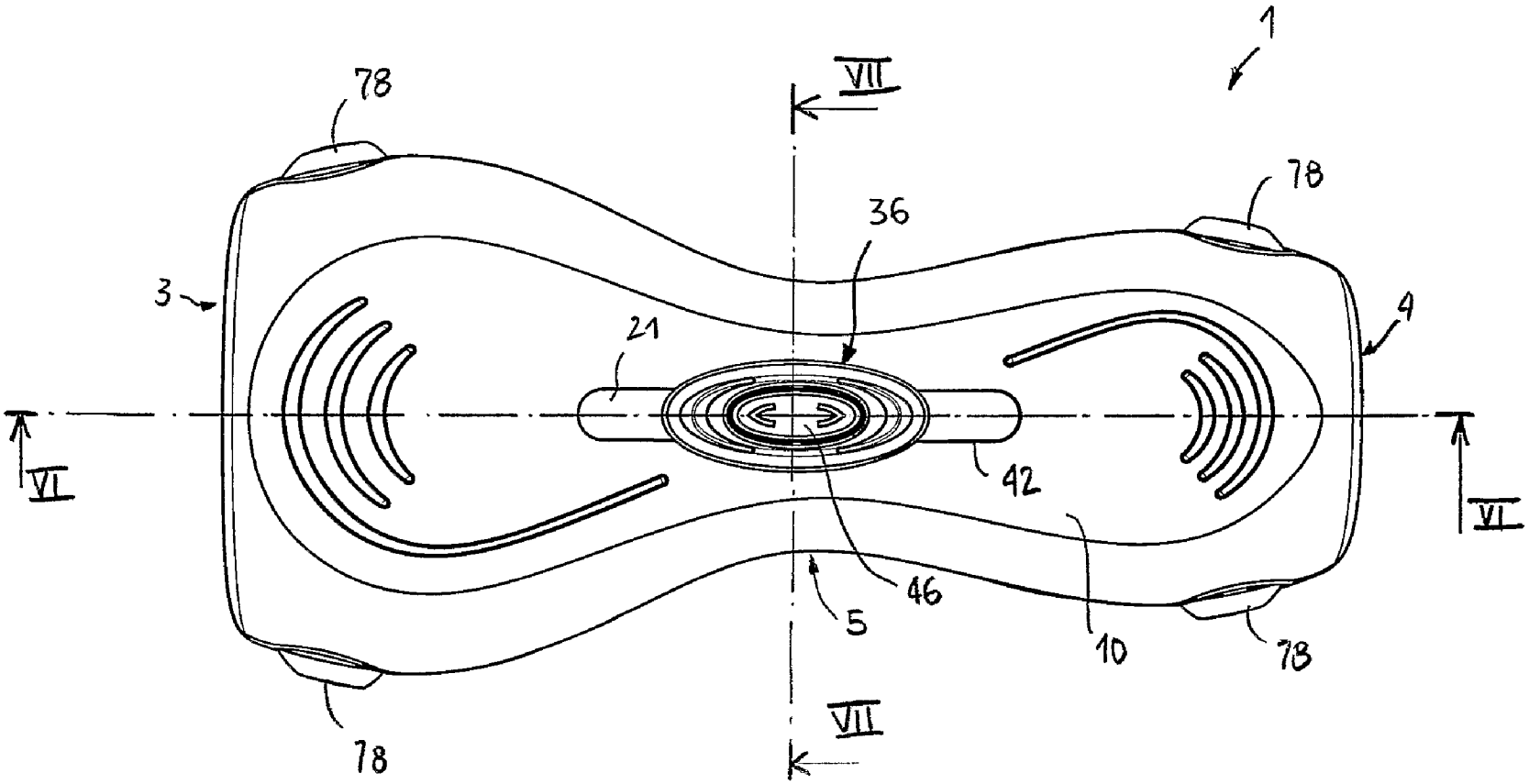
FIG. 4 is an top view of the razor of the preceding figures, in the intermediate position.

The heads 6, 7 preferably have different sizes, the first one 6 having a standard shaver width W6 while the second one 7 has a shaver width W7 which is less than W6 (see FIGS. 1 and 3).

Standard head 6 is used in normal shaving (beard, legs), while the narrow one 7 is dimensioned for easy maneuverability in order to facilitate accurate trimming of particular hair areas, e.g. moustaches, sideburns or pubic hairs.

As the standard head 6, the narrow head 7 is movable with respect to the handle 2 along a direction parallel to the handle axis X, between:

a use position in which the narrow head 7 projects outward from the back end 4 of the handle 2 (FIGS. 3, 12), and a retracted position in which the narrow head 7 is lodged within the housing formed by the handle 2 (FIGS. 1, 2, 6, 11).

In its use position, the narrow head 7 is ready for use to allow shaving, while in the retracted position it is hidden in the handle 2 so that it is inoperable and unreachable with the fingers to be protected from damage and avoid any accidental cutting.

Figure 6:
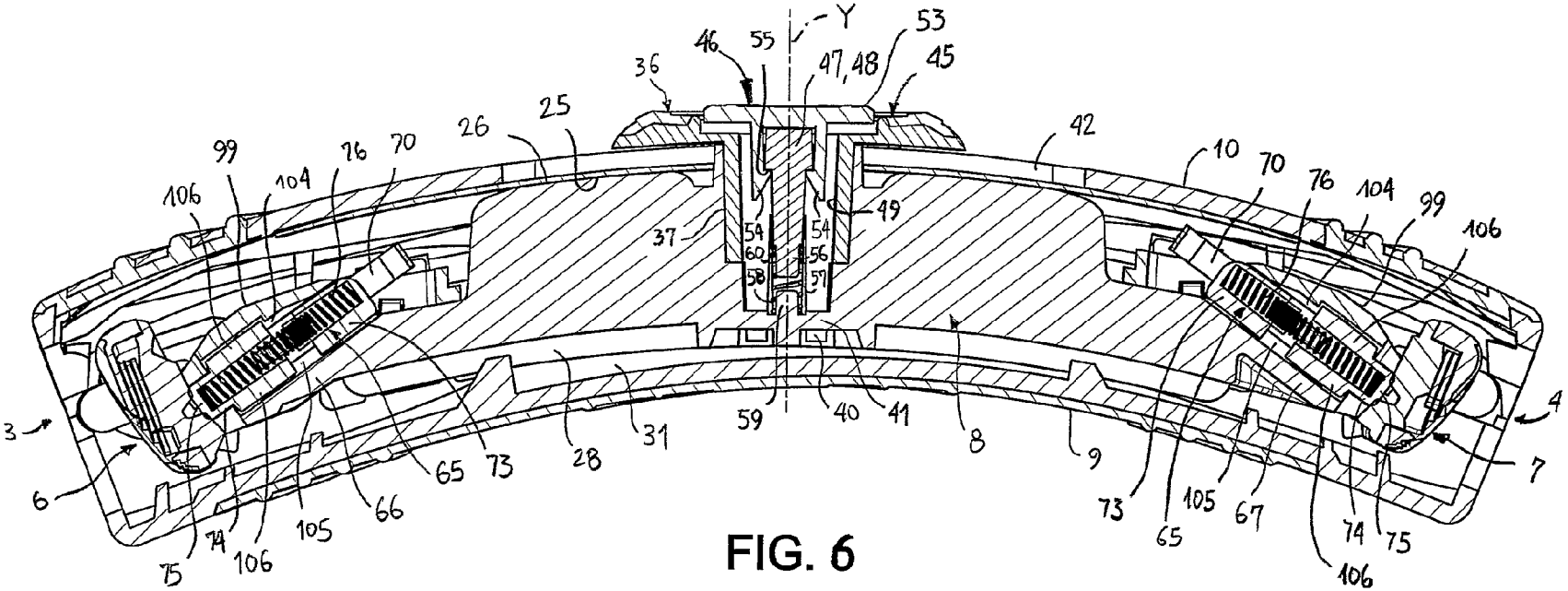
FIG. 6 is a longitudinal elevational cut view of the razor of the preceding figures, taken along the line VI-VI of FIG. 4.
Figure 7:
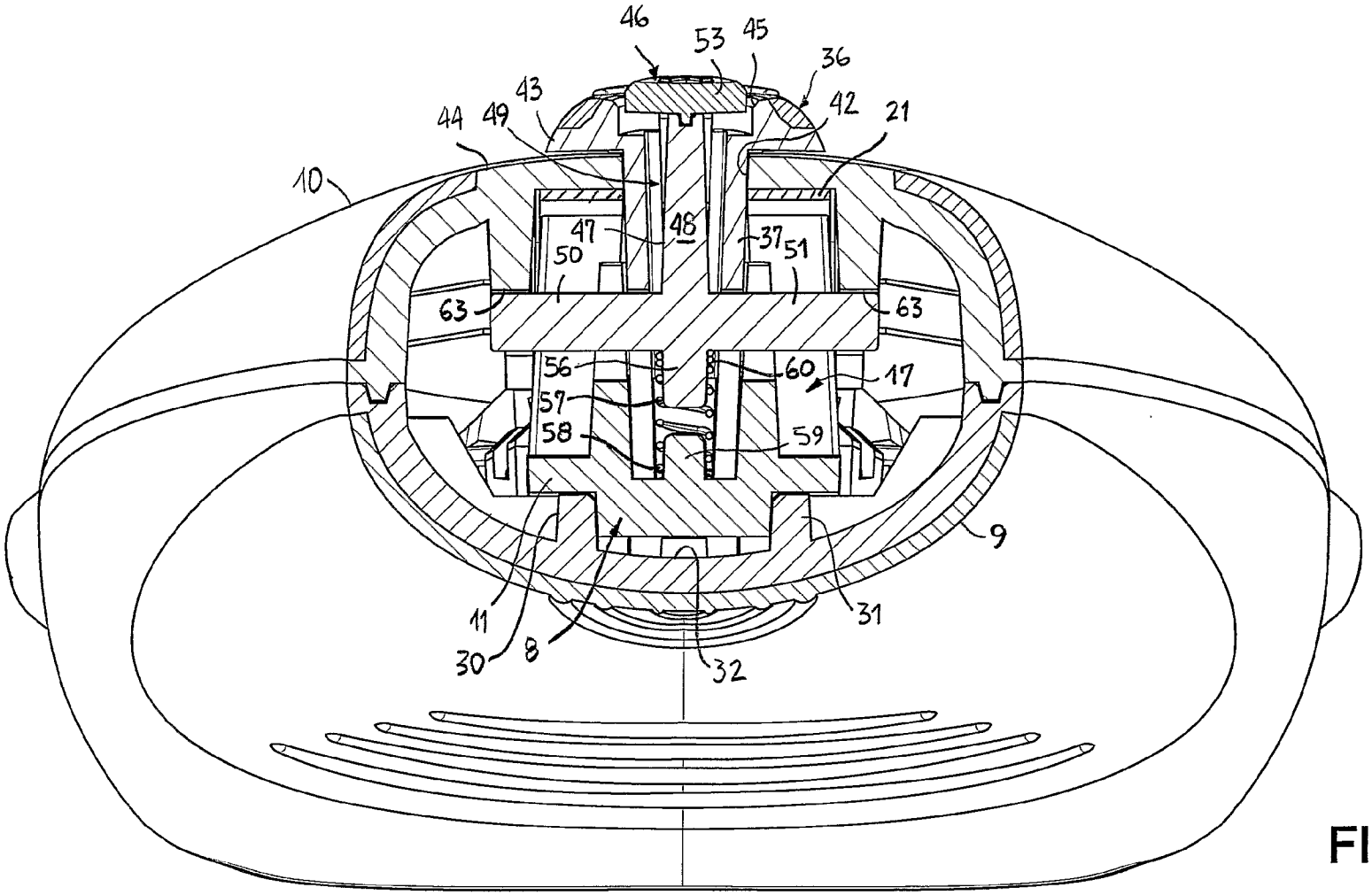
FIG. 7 is a transversal elevational cut view of the razor of the preceding figures, taken along the line VII-VII of FIG. 4.
Figure 8:
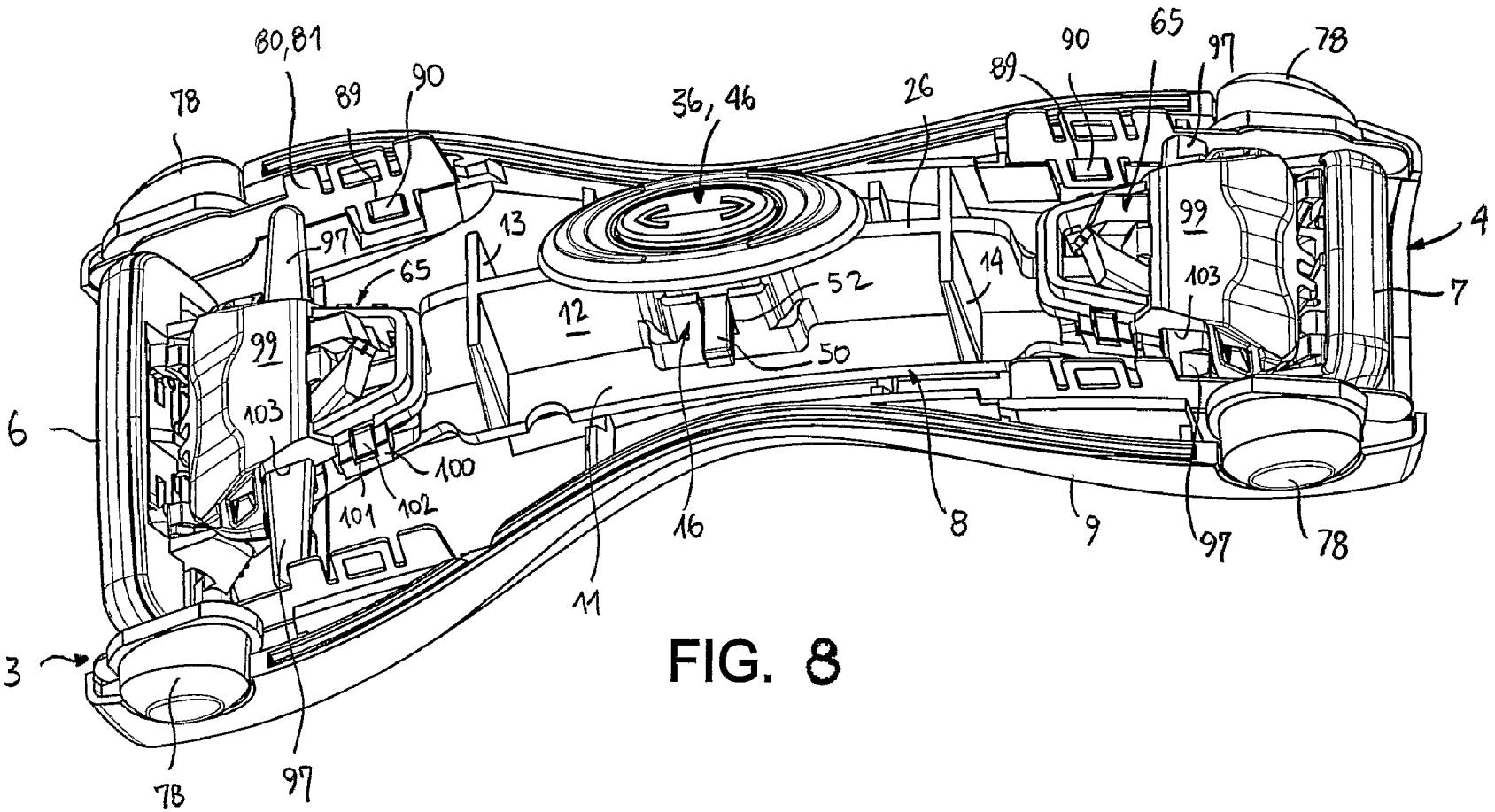
FIG. 8 is a partial perspective top view of the razor of the preceding figures, shown in the intermediate position.

Both heads 6, 7 are mounted on a common support or platform member 8 which is in turn mounted in the handle 2 so as to be safely slideable with respect to the same, between:

a first use position (FIG. 11) in which the standard head 6 is in its use position while the narrow one 7 is in its retracted position, a second use position (FIG. 12) in which the standard head 6 is in its retracted position while the narrow one 7 is in its use position, and an intermediate position (FIGS. 6, 8, 9) in which both shaving heads 6, 7 are in their retracted position (FIGS. 6, 8).

Figure 9:
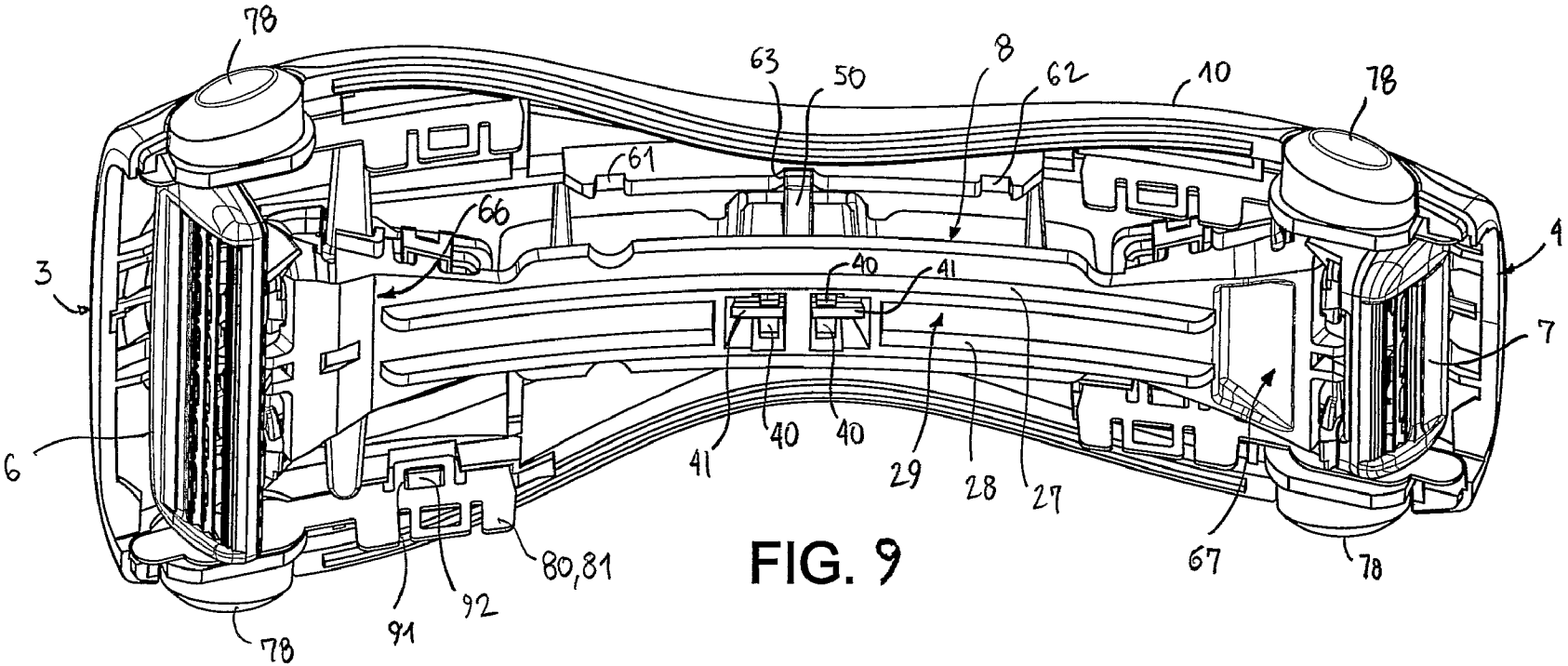
FIG. 9 is a partial perspective bottom view of the razor of the preceding figures, shown in the intermediate position.

As illustrated on FIG. 5, handle 2 comprises a bottom shell member 9 and a top shell member 10 which are permanently attached to one another and together enclose the sliding platform member. FIG. 8 is a perspective top view of the razor 1 from which the top shell member 10 has been removed to show the inside of the razor 1. FIG. 9 is, in turn, a perspective bottom view of the razor 1 from which the bottom shell member 9 has been removed to show the inside of the razor 1.

As illustrated in FIG. 8, the platform member 8 comprises an elongated arcuate plate member 11 which has substantially the same curvature as the handle 2. Platform member 8 comprises a longitudinal stiffening rib 12 and two spaced transversal ribs 13, 14 which protrude from a top surface 15 of the plate member 11, and also a hollow central housing 16 defined, on the one hand, by a pair of opposed transversal walls 17, 18 protruding from the top surface 15, and, on the other hand, by a pair of opposed longitudinal side walls 19, 20 also protruding from the top surface 15 in the continuity of the transversal walls 17, 18.

A flat arcuate guiding plate 21 is clipped onto the platform member 8. More precisely, the guiding plate 21 is provided with a central hole 22, the edge of which cooperates with hooks 23, 24 protruding from the transversal walls 17, 18. The guiding plate 21 has a bottom surface 25 which is in contact with a top edge 26 of the stiffening ribs 12, 13, 14, thereby providing stable mounting of the guiding plate 21 on the platform member 8.

Platform member 8 also comprises a pair of parallel ribs 27, 28 protruding from a lower surface 29 of the platform member 8, and which extend longitudinally substantially all along the length of the platform member 8.

As illustrated in FIG. 5, the handle 2 is provided with means for guiding the sliding platform member 8, which comprise two parallel elongated bottom rails 30, 31 protruding from an inner bottom surface 32 of the bottom shell member 9, and extending along each lateral side of the pair of parallel ribs 27, 28.

The guiding means also comprise two parallel elongated top rails 33, 34 protruding from an inner top surface 35 of the top shell member 10, extending along lateral edges of the guiding plate 21.

As a result, the platform member 8 is precisely slidingly guided between the bottom shell member 9 and the top shell member 10.

Razor 1 further comprises a manually operable actuator 36 which is slideable with respect of the top shell member 10 along a direction substantially parallel to the handle axis X, for moving the platform member 8 from one position to the other.

As illustrated on FIG. 8, the actuator 36 is mounted on the platform member and comprises a cylindrical hollow body 37 which has four projecting parallel flexible lugs 38 passing through a central aperture 39 defined in the platform member 8 by the housing 16. The lugs 38 are provided with hooks 40 which engage longitudinal bridge members 41 extending across the central aperture 39, so that the actuator 36 is clipped on the platform member 8.

The hollow body 37 of the actuator 36 preferably passes through an elongated aperture 42 which is formed in the top shell member 10 between the top rails 33, 34. The actuator 36 also has a substantially flat head 43 which projects, at one end of the body 37 opposite to the lugs 38, from a top external surface 44 of the top shell member 10.

The head comprises a recess 45 for receiving a finger (e.g. the thumb) of a user to help him grip the actuator 36.

The actuator 36 also comprises a release button 46 including a pusher 47 which is slidingly mounted in the body 37 along an elevational axis Y substantially perpendicular to the handle axis X. Pusher 47 has a main body 48 mounted in a corresponding bore 49 formed in the body 37 of the actuator 36, and diametrically opposed transversal arms 50, 51 which project laterally from the main body 48 and which are received in respective lateral slots 52 formed in the longitudinal side walls 19, 20 of the housing 16.

The release button 46 also includes a cover member 53, which projects from the recess 45 to be accessible for a user's finger, and which is clipped onto the pusher 47 by means of hooks 54 cooperating with corresponding shoulder surfaces 55 formed on the main body 48 of the pusher 47.

Pusher 47 is slideable with respect of the body 37 along the elevational axis Y, between a locking position in which the pusher 47 is at a distance from the plate member 11, the cover member 53 projecting from the recess 45, and an unlocking position in which the pusher 47 is close to the plate member 11, the cover member 53 being at least partly received within the recess 45.

Pusher 47 comprises a cylindrical pin 56, in the continuity of the main body 48 on the other side of the transversal arms 50, 51, so that the pusher 47 is substantially cross-shaped.

A return spring 57 is mounted in compression between the pusher 47 and the platform member 8, so as to permanently bias the pusher 47 towards its locking position. More precisely, spring 57 has a bottom end 58 which is mounted onto a pin 59 protruding from the plate 11, and a top end 60 which is mounted on the pin 56 of the pusher 47, the pins 56, 59 thereby together forming spring guiding means.

Figure 10:
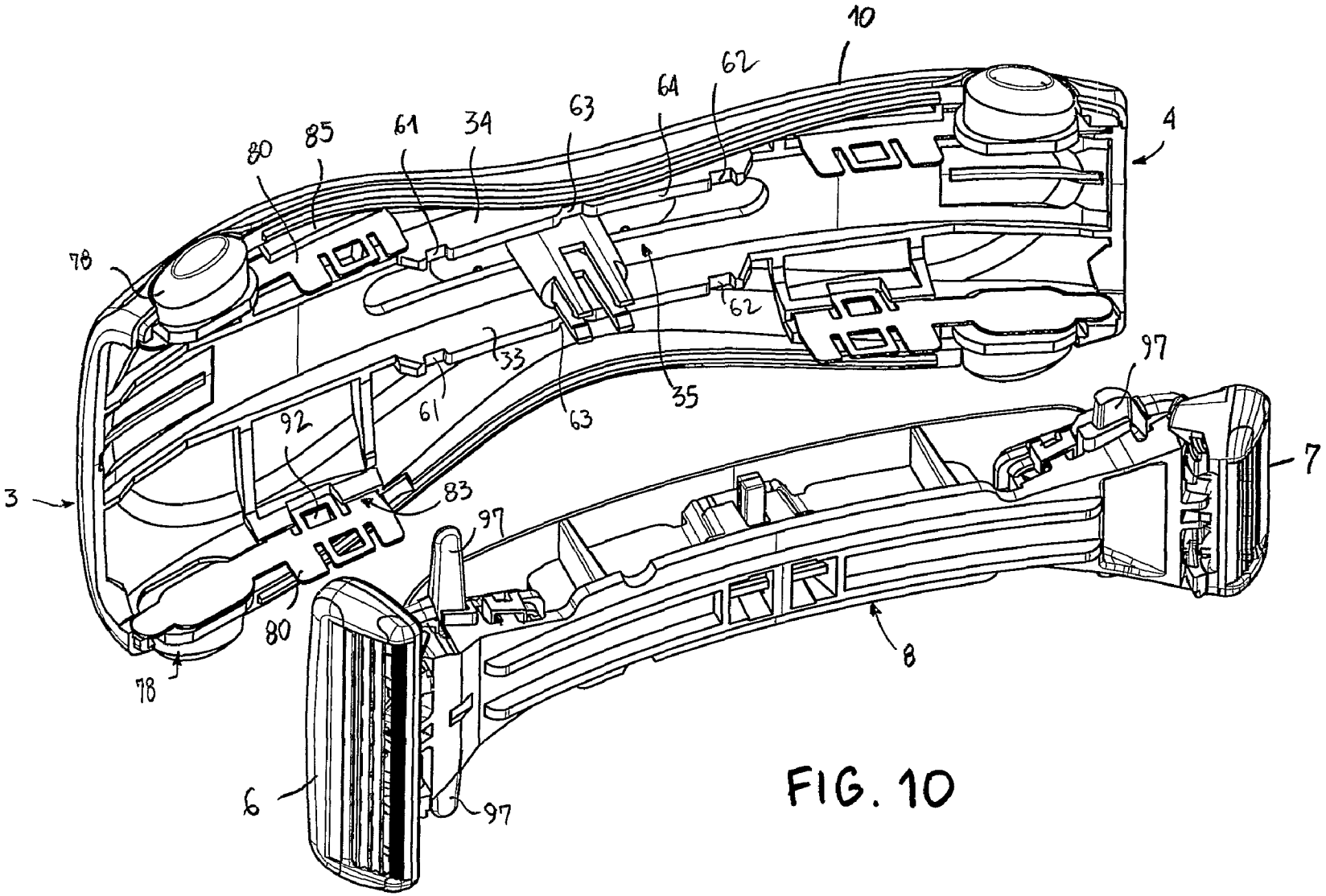
FIG. 10 is an exploded partial perspective bottom view of the razor of FIG. 9.

As illustrated in FIG. 10, each top rail 33, 34 is provided with three spaced apart slots 61, 62, 63, in which the transversal arms 50, 51 are capable of being received, depending on the position of the actuator 36, i.e. a front end slot 61, located near the front end 3 of the handle 2, a hack end slot 62, located near the back end 4, and an intermediate slot 63, located between the front end slot 61 and the back end slot 62.

As illustrated in FIG. 9, in the intermediate position of the actuator 36, the arms 50, 51, which act as locking means for locking the platform member 8 in position, are received in the intermediate slots 63. In this position, the platform member 8 is in its intermediate position, both shaving heads 6, 7 being received within the handle 2.

As the spring 57 biases the pusher 47 to its locking position, the arms 50, 51 abut longitudinally against transversal shoulder surfaces of the intermediate slots 63, thereby preventing the platform member 8 to move longitudinally.

Whenever the user wants to take out any of the shaving heads 6, 7, he squeezes the release button 46 against the action of the return spring 57, thereby releasing the arms 50, 51 from the intermediate slot 63. The user is then capable of sliding the actuator 36 in each direction with respect of the handle 2 so as to move the platform member 8 toward the first or the second use position.

During movement of the platform member 8 toward any of the first or second use positions, the platform member 8 being precisely guided by the top and bottom rails 30, 31, 33, 34 as described hereabove, the arms 50, 51 slide onto edges 64 of the top rails 33, 34, thereby holding the pusher 47 in its unlocking position.

As soon as the arms 50, 51 come in front e.g. of the front end slot 61, the return spring 57 suddenly moves the pusher 47 toward its locking position, where the arms 50, 51 are clipped in the front end slots 61, thereby locking the platform member 8 in its first use position.

Respectively, as soon as the arms 50, 51 come in front of the back end slot 62, the spring 57 suddenly moves the pusher 47 toward its locking position, where the arms 50, 51 are clipped in the back end slots 62, thereby locking the platform member 8 in its second use position.

Accordingly, whichever the position of platform member 8 is, it is strongly held in position with respect of the handle 2, thereby preventing the heads 6, 7 from accidentally moving from one position to the other. Accordingly, there is low risk that a user cuts himself or herself with one head while shaving with the other. Moreover, since the actuator 36 is on a top side of the razor 1, there is also low risk that during shaving the fingers of the user, which grasp the razor 1 by its lateral faces, accidentally move the actuator 36. This further increases safety of the razor 1.

Moreover, whichever the position of the platform member 8 is, the flat arcuate guiding plate 11 always blanks the elongated aperture 42, thereby preventing visual access to the technical parts inside the handle 2 and therefore enhancing visual aspect of the razor 1.

In addition, each shaving head 6, 7 is disposed in a replaceable cartridge which is removably attached to the platform member 8 so that after the edges of the blades are dulled the cartridges 6, 7 are disposed of and replaced by new ones.

In order to achieve replacement of the shaving heads 6, 7, the razor 1 includes two lock-and-release mechanisms 65, respectively mounted in seats 66, 67 provided at both ends of the platform member 8.

Each lock-and-release mechanism 65 includes a resilient V-shaped retainer 68 having two legs 69, 70 movable toward and away from each other. Bearing members 71 are formed at the ends of the legs 69, 70, removably attached to corresponding curved hooks 72 provided on the back side of the corresponding shaving head 6, 7 to permit swiveling movement of the shaving head 6, 7 with respect of the platform member 8.

A cam member 73 is mounted between the legs 69, 70 for permanently biasing them away from each other in order to maintain the bearing members 71 in cooperation with the corresponding hooks 72. Between the legs 69, 70 is also mounted a plunger 74, a front portion 75 of which is in contact with a V-shaped cam surface provided on the back side of the shaving head 6, 7. A compression spring 76, interposed between the plunger 74 and the cam member 73, biases them away from each other, thereby pushing forward the plunger 74 to maintain permanent contact of the latter with the shaving head 6, 7, and pushing backwards the cam member 73 to maintain permanent contact of the latter with the legs 69, 70.

The lock-and-release mechanism 65 is triggered by actuators 77 mounted near the ends 3, 4 of the handle 2. Each actuator 77 includes a button 78 which is mounted on a flexible front portion 79 of a flat metal spring member 80, a fixed back portion 81 of which is rigidly maintained in grooves 82, 83 formed in side walls 84, 85 of the bottom and top shell members 9, 10.

The front portion 79 of each flat spring member 80 extends longitudinally across an oval-shaped side opening 86 formed in the vicinity of each end of the handle by complementary cut-outs 87, 88 in the shell members 9, 10.

Each spring member 80 is provided with two rectangular holes formed in the fixed back portion, i.e. a bottom hole 89, which cooperates with a hook 90 formed in the side wall 84 of the bottom shell member 9, and a top hole 91 which cooperates with a hook 92 formed in the side wall 85 of the top shell member 10. The spring members 80 thereby form clip members which hold the bottom and top shell members 9, 10 together.

Each button 78 has an oval-shaped main body 93 which extends transversally through the opening 86 to be accessible for the fingers of the user, and a base portion 94 having an inwardly directed flat surface 95 in contact with the front portion 79 of the spring member 80, and an outwardly directed shoulder surface 96 which abuts against an inner edge of the opening 86.

Each leg 69, 70 has a transversally protruding wing 97, an end of which is in contact with an inner surface 98 of the flat spring member 80.

As depicted on FIG. 8, each lock-and-release mechanism 65 is attached to the platform member 8 by means of a cover member 99, which is clipped onto the platform member 8, thereby sandwiching the lock-and-release mechanism 65 and holding it in place. More precisely, the cover member 99 comprises lateral flanges 100 provided with openings 101, edges of which cooperate with corresponding hooks 102 provided on the platform member 8. Cut-outs 103 are formed in side walls of the cover member 99 for free passage of the wings 97.

Longitudinal grooves 104, 105 are formed in the cover member 99 and in the platform member 8, cooperating with corresponding ribs 106 provided on the plunger 74 in order to guide forth and back movement of the latter.

In the use position, wherein the razor head 6 or 7 protrudes from the corresponding end 3 or 4 of the handle 2, the wings 97 contact the flexible front portion 79 of the flat spring member 80, so that, under manual action, movement of the buttons 78 toward each other biases the legs 69, 70, via the wings 97, thereby releasing the bearing members 71 from the hooks 72, whereas forward movement of the plunger 74 wider bias of the spring 76 ejects the shaving head 6 or 7 and allows for disposal and replacement of the latter.

In the intermediate position or in the other use position of the platform member 8, wherein the razor head 6 or 7 is received within the handle 2, the wings 97 contact the fixed back portion 81 of the flat spring member 80, so that movement of the buttons 78 has no effect on the legs 69, 70, thereby preventing disposal and replacement of the razor head 6 or 7 when it is not in use position. Making it is possible to replace a shaving head only when it is in its use position prevents any wrong action on the buttons from accidentally ejecting head when disposal and replacement are not necessary.

Figure 16:
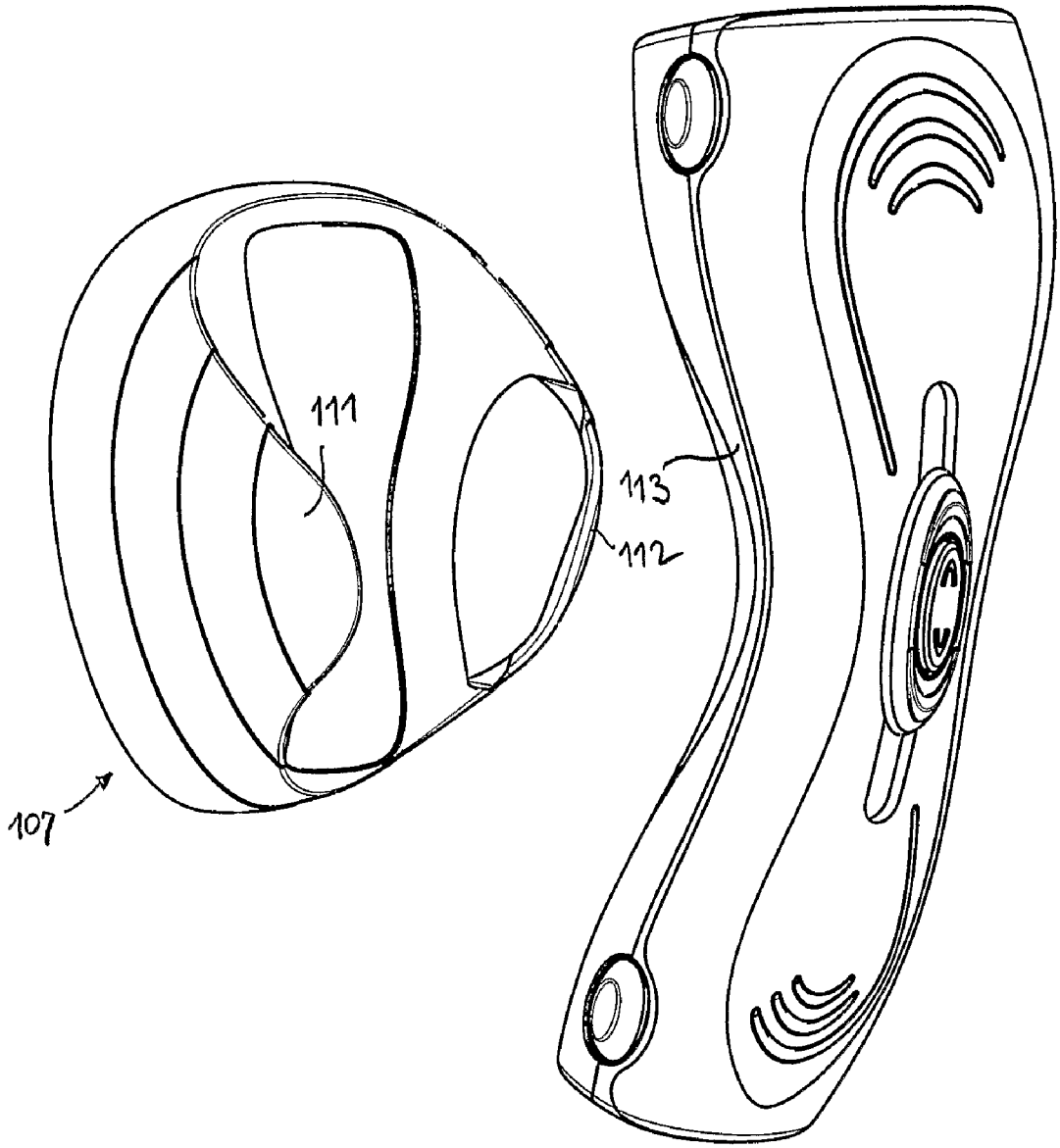
FIG. 16 is an exploded perspective view showing the holder of FIG. 15 and the razor of the preceding figures.
Figure 17:
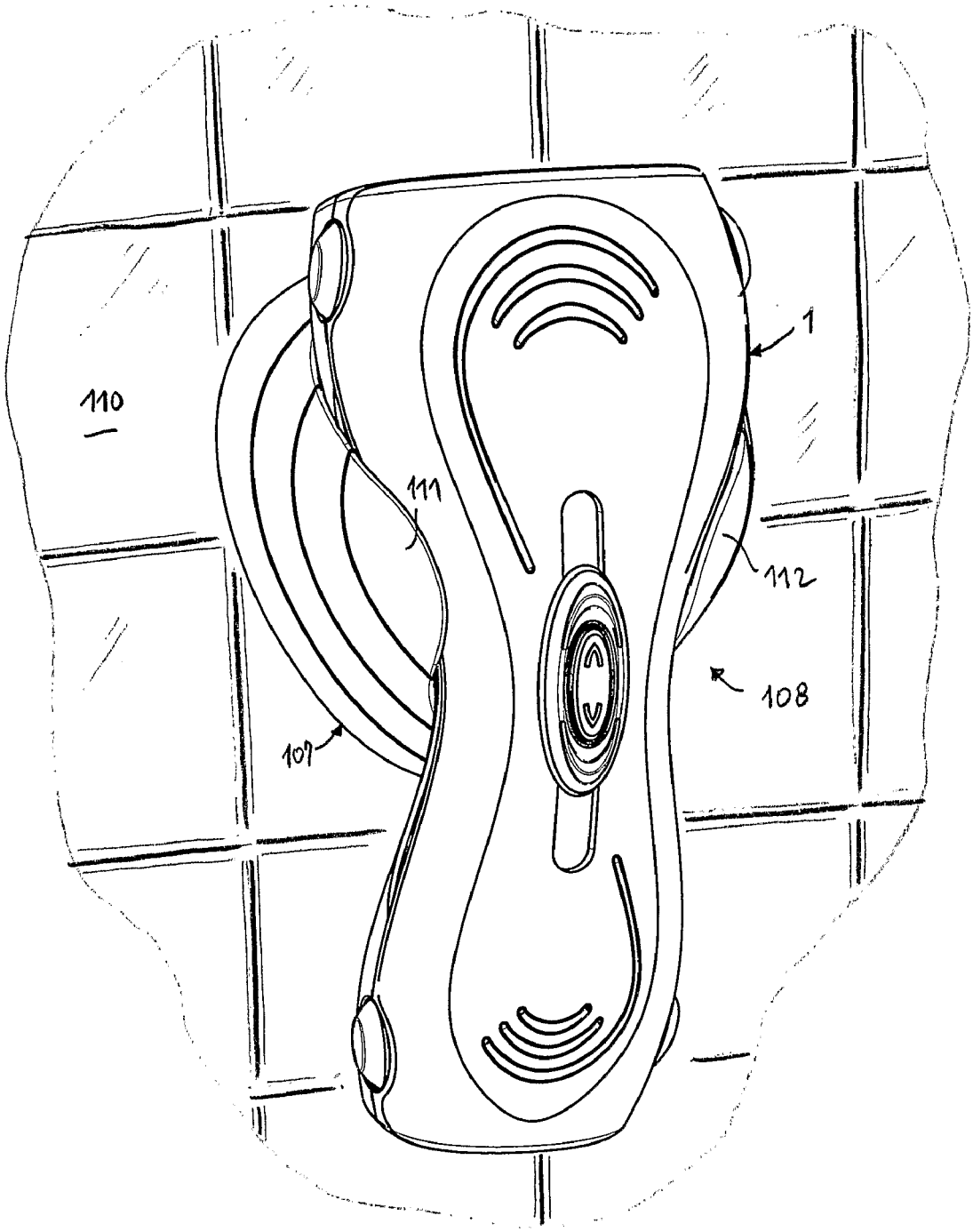
FIG. 17 is a perspective view showing the assembly of the holder of FIGS. 15 and 16 and the razor of the preceding figures.
Figure 18:
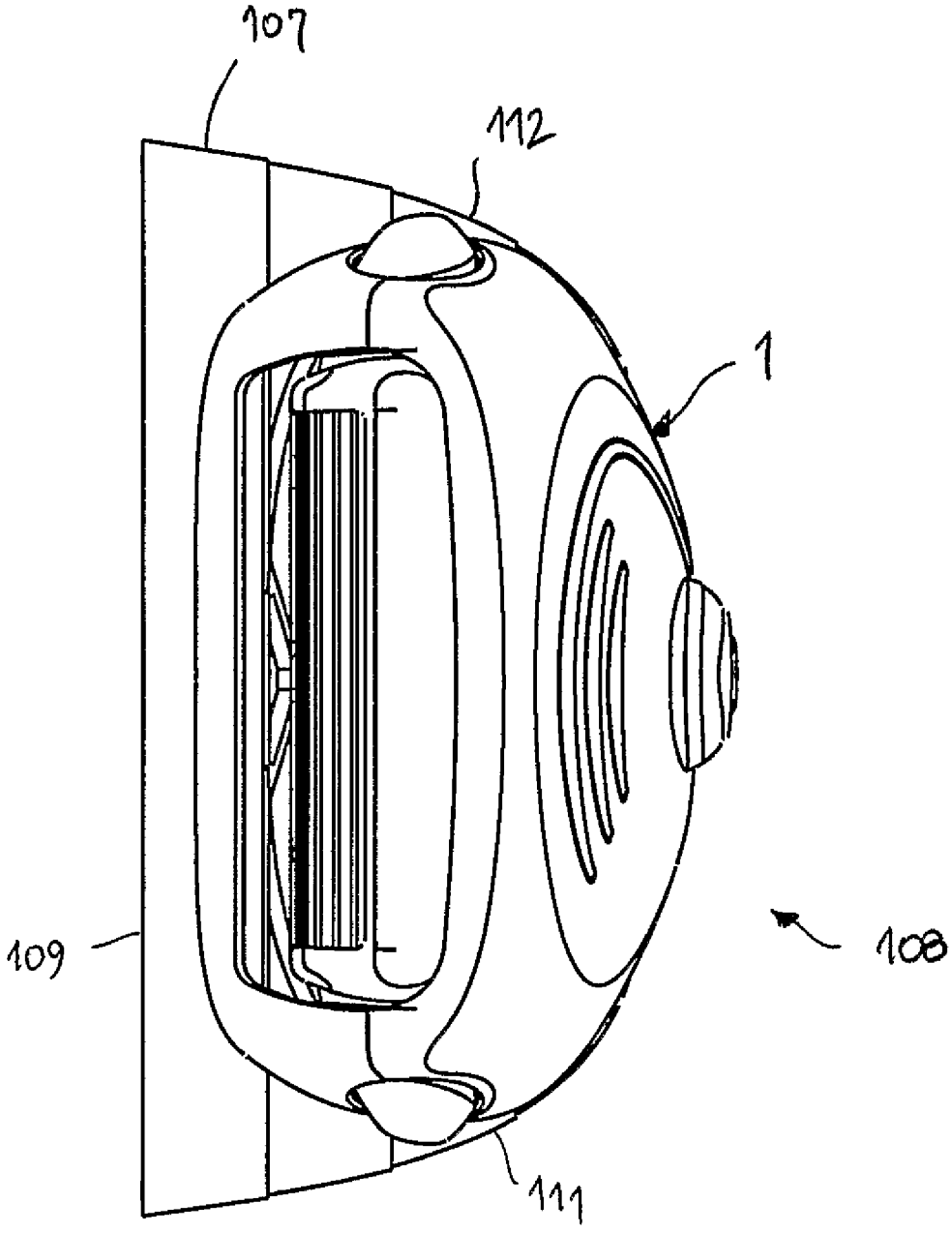
FIG. 18 is a planar top view of the assembly of FIG. 17.

As depicted on FIGS. 16 and 17, razor 1 can be removably mounted on a razor holder 107 to form a shaving system 108. Holder 107 has a planar back wall 109 for attachment to a wall 110, e.g. a bathroom or a shower wall, by means of a double-sided adhesive pad, a suction cup or any suitable equivalent means.

Figure 15:
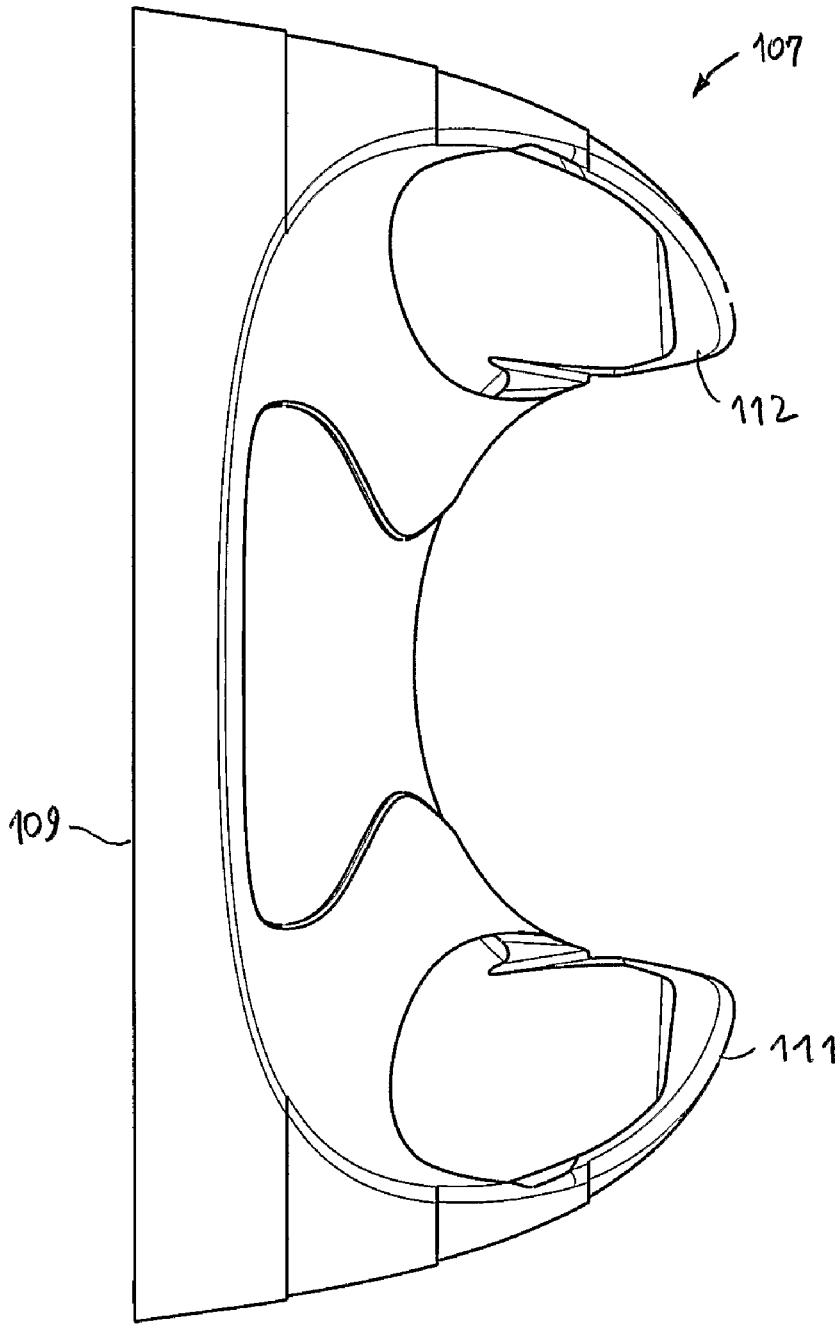
FIG. 15 is a planar top view showing a holder for the razor of the preceding figures.

Holder 107 comprises lateral wings 111, 112 for engaging the razor handle 2, the wings 111, 112 together forming a V-shaped seat against which abuts a complementary side surface 113 of the handle 2, located in the vicinity of the central constriction 5. As depicted on FIG. 15, the wings 111, 112 are curved toward each other, so as to follow the curvature of the side surface 113 and firmly retain the razor 2 by simple vertical interlocking.

In the above recited embodiment, both ends 3, 4 of the handle 2 are permanently open. However, in optional embodiments, they may be at least partially and/or temporarily covered by cover members.

In a first optional embodiment, the razor is provided with movable flaps which are slidingly mounted on the handle under control of the platform actuator, between:

a closed position in which each flap covers a corresponding end of the handle, so as to prevent manual access to the blades and protect the inside of the handle (in particular against dust and moisture), and an open position in which each flap uncovers the corresponding end, so as to allow the razor head to project outward from the end.

In a second optional embodiment, the razor is provided with manually removable lids which are mounted onto the ends of the handle whenever the corresponding razor heads are in retracted position, so as to prevent manual access to the blade and protect the inside of the handle. As soon as the user needs to use one of the razor heads, he simply has to remove the corresponding lid.

In a third optional embodiment, each end of the razor handle is provided with a flexible terminal wall (e.g. made of thermoelastic or rubber material) which allows the corresponding razor head to pass through when moving from its use position to its retracted position, and vice-versa.

For instance, this terminal wall is provided with a central slot through which the corresponding razor head is able to pass while distorting the wall. The terminal wall forms a shield which prevents manual access to the blades and protects the inside of the handle, in particular against dust and moisture.

This specification is not intended to limit the scope of the claims. Someone of ordinary skill in the art will readily understand that changes may be make to the above-described embodiments of the present invention without deviating from the scope of the embodiment of the present invention. Moreover, any use of the world "preferred" in the specification is not intended to limit the scope of the claims. Rather, the word preferably is used to satisfy the best make requirements as provided in 35 U.S.C. §112, first paragraph.

The invention claimed is:

1. A razor comprising:

an elongated hollow handle having a longitudinal axis X, said handle having a front end and a back end opposite to the front end;

a first razor head and a second razor head both mounted on a support mounted in said handle, each head having a width, each said width extending substantially parallel to an edge of a razor blade of each razor head and extending substantially perpendicular to the axis X, each head capable of being slideable in a direction substantially parallel to the axis X, between at least:

a first use position in which said first razor head projects outward from the front end to allow shaving, while said second razor head is retracted in said handle, and a second use position in which said second razor head projects outward from the back end to allow shaving, while said first razor head is retracted in said handle;

a manually operable actuator mounted on the support for moving the support from the first use position to the second use position or from the second use position to the first use position; and locking means for locking the support in the first or second use position, said locking means being at least partly provided on the manually operable actuator, wherein the manually operable actuator extends from the support in a direction generally perpendicular to one of said widths and to said axis X, the manually operable actuator comprising a release button including a pusher and a cover member, the cover member being clipped onto the pusher, the pusher being movable between a locking position in which the manually operable actuator cannot be moved and an unlocking position in which the manually operable actuator can be moved, and a recess for receiving a finger of a user to help the user grip the manually operable actuator, the cover member projecting from the recess in the locking position and being at least partly received within the recess in the unlocking position.

2. A razor according to claim 1, wherein the support is capable of occupying a third or intermediate position in which both razor heads are retracted in said handle.

3. A razor according to claim 1, wherein the locking means are further provided for locking the support in the intermediate position.

4. A razor comprising:

an elongated hollow handle having a longitudinal axis X, said handle having a front end and a back end opposite to the front end;

a first razor head and a second razor head, both mounted on a support mounted in said handle, each head having a width, each said width extending substantially parallel to an edge of a razor blade of each razor head and extending substantially perpendicular to the axis X, each head capable of being slideable in a direction substantially parallel to the axis X, between at least:

a first use position in which said first razor head projects outward from the front end to allow shaving, while said second razor head is retracted in said handle, and a second use position in which said second razor head projects outward from the back end to allow shaving, while said first razor head is retracted in said handle;

a manually operable actuator mounted on the support for moving the support from the first use position to the second use position or from the second use position to the first use position, and locking means for locking the support in the first or second use position, said locking means being at least partly provided on the manually operable actuator, wherein the manually operable actuator comprises a hollow body passing through an aperture provided on the handle, the manually operable actuator extending from the support in a direction generally perpendicular to one of said widths and to said axis X, a release button including a pusher and a cover member, the cover member being clipped onto the pusher, the pusher being movable in the hollow body between a locking position in which the manually operable actuator cannot be moved and an unlocking position in which the manually operable actuator can be moved, and a recess for receiving a finger of a user to help the user grip the manually operable actuator, the cover member projecting from the recess in the locking position and being at least partly received within the recess in the unlocking position.

5. A razor according to claim 4, wherein the support is capable of occupying a third or intermediate position in which both razor heads are retracted in said handle.

6. A razor according to claim 4, wherein the locking means are further provided for locking the support in the intermediate position.

* * * * *